US011346158B2

(12) United States Patent
Graham et al.

(10) Patent No.: US 11,346,158 B2
(45) Date of Patent: May 31, 2022

(54) HOLE OPENER FOR DIRECTIONAL DRILLING

(71) Applicant: Precise Drilling Components Ltd, Calgary (CA)

(72) Inventors: Cody D. Graham, Calgary (CA); Jeffrey S. Mueller, Brownsville, WI (US)

(73) Assignee: Precise Drilling Components Ltd, Calgary (CA)

( * ) Notice: Subject to any disclaimer, the term of this patent is extended or adjusted under 35 U.S.C. 154(b) by 0 days.

(21) Appl. No.: 16/937,676

(22) Filed: Jul. 24, 2020

(65) Prior Publication Data

US 2021/0025242 A1 Jan. 28, 2021

Related U.S. Application Data

(60) Provisional application No. 62/878,228, filed on Jul. 24, 2019.

(51) Int. Cl.

| | |
|---|---|
| ***E21B 10/26*** | (2006.01) |
| ***E21B 10/60*** | (2006.01) |
| ***E21B 7/04*** | (2006.01) |
| ***E21B 10/633*** | (2006.01) |
| ***E21B 7/28*** | (2006.01) |
| ***E21B 10/567*** | (2006.01) |

(52) U.S. Cl.

CPC ..... *E21B 10/26* (2013.01); *E21B 7/046* (2013.01); *E21B 7/28* (2013.01); *E21B 10/567* (2013.01); *E21B 10/60* (2013.01); *E21B 10/633* (2013.01)

(58) Field of Classification Search

CPC ..... E21B 10/26; E21B 10/567; E21B 10/60; E21B 10/633; E21B 7/046; E21B 7/28

See application file for complete search history.

(56) References Cited

U.S. PATENT DOCUMENTS

| | | | | |
|---|---|---|---|---|
| 5,337,843 | A | 8/1994 | Torgrimsen et al. | |
| 2010/0175927 | A1* | 7/2010 | Zulak | E21B 10/26 175/413 |
| 2014/0353032 | A1 | 12/2014 | Radford et al. | |
| 2018/0274302 | A1* | 9/2018 | Zhang | E21B 10/567 |

FOREIGN PATENT DOCUMENTS

| | | | | |
|---|---|---|---|---|
| WO | 2016135511 | A1 | 9/2016 | |
| WO | WO-2021003242 | A1 * | 1/2021 | E21B 7/28 |

OTHER PUBLICATIONS

Office Action issued from the Canadian Patent Office for related Application No. 3087893 dated Oct. 14, 2021 (5 Pages).

* cited by examiner

*Primary Examiner* — Caroline N Butcher
(74) *Attorney, Agent, or Firm* — Michael Best & Friedrich LLP

(57) ABSTRACT

A hole opener configured for use with a directional drilling rig, the hole opener includes a shaft and a plurality of flutes that extend outwardly from the shaft. Each of the flutes includes a first side, a second side opposite the first side, and a top side that extends from the first side to the second side. Each of the plurality of flutes includes a plurality of recesses in the top side that are spaced apart along the top side of the flute in a direction from the first end of the shaft toward the second end of the shaft. The hole opener further includes a plurality of cutter blocks, each of the plurality of cutter blocks includes a base and a cutter attached to the base. The base is received in one of the plurality of recesses to removably coupled the cutter block to the flute.

20 Claims, 5 Drawing Sheets

HOLE OPENER FOR DIRECTIONAL DRILLING

CROSS-REFERENCE TO RELATED APPLICATIONS

This application claims priority to U.S. Provisional Patent Application No. 62/878,228, filed Jul. 24, 2019, the entire contents of which are hereby incorporated by reference herein.

BACKGROUND

The present invention relates to a hole opener particularly suited for use with a directional drilling rig.

SUMMARY

In one embodiment, the invention provides a hole opener configured for use with a directional drilling rig. The hole opener includes a shaft configured for rotation by the directional drilling rig about a longitudinal axis, and the shaft includes a first end and a second end opposite the first end. The hole opener further includes a plurality of flutes that extend outwardly from the shaft. Each of the plurality of flutes is spaced from adjacent flutes in a direction around the longitudinal axis and each of the flutes includes a first side that faces toward an adjacent flute, a second side that faces toward an adjacent flute opposite the first side, and a top side that extends from the first side to the second side. Each of the plurality of flutes further includes a plurality of recesses in the top side that are spaced apart along the top side of the flute in a direction from the first end of the shaft toward the second end of the shaft. The hole opener further includes a plurality of cutter blocks, each of the plurality of cutter blocks includes a base and a cutter attached to the base, the base is received in one of the plurality of recesses to removably coupled the cutter block to the flute.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
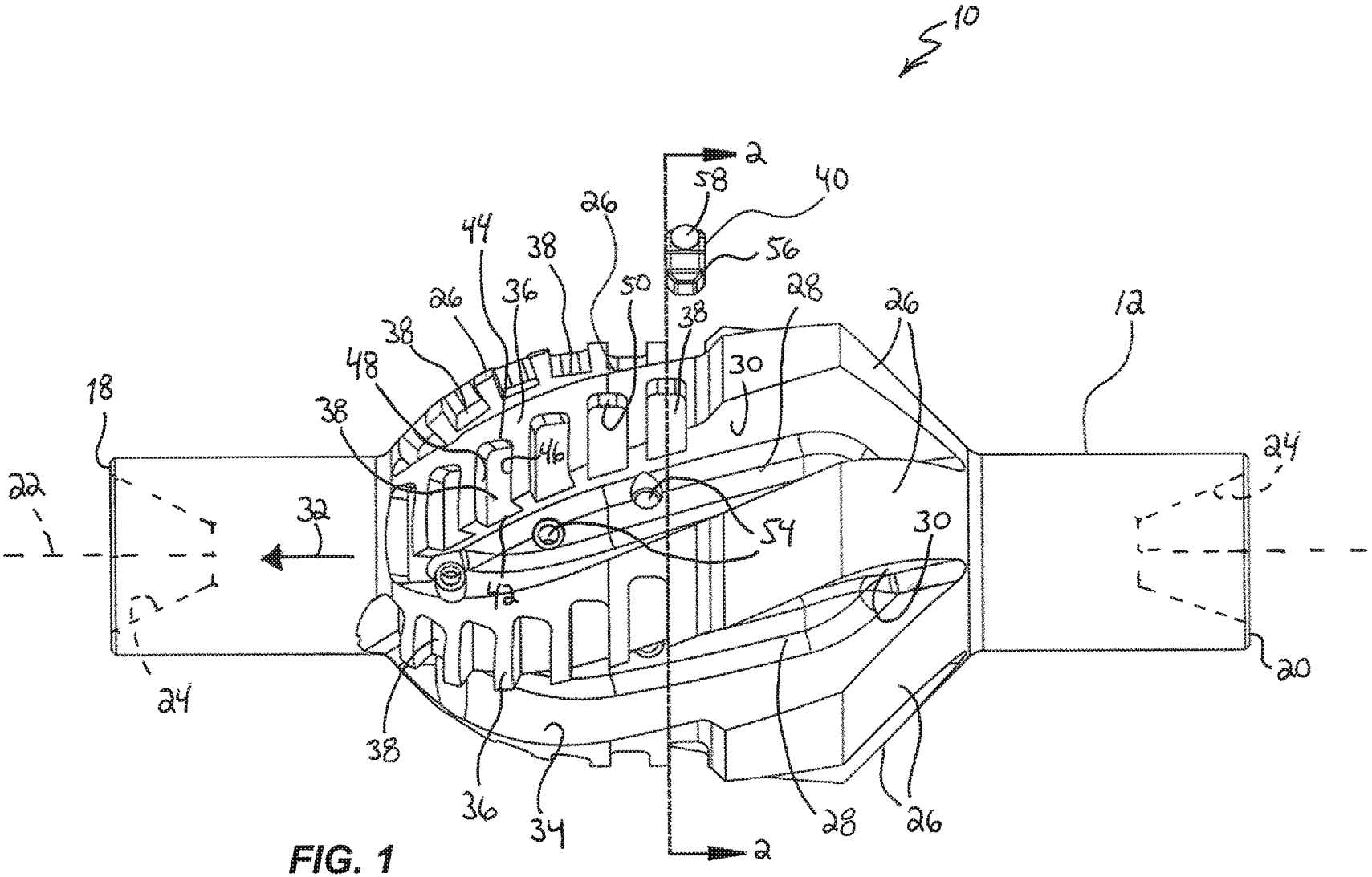
FIG. 1 is a side view of a hole opener according to one embodiment of the invention.

FIG. 1 illustrates a hole opener or reamer 10. The illustrated reamer 10 includes a shaft 12 for coupling the reamer

Figure 6:
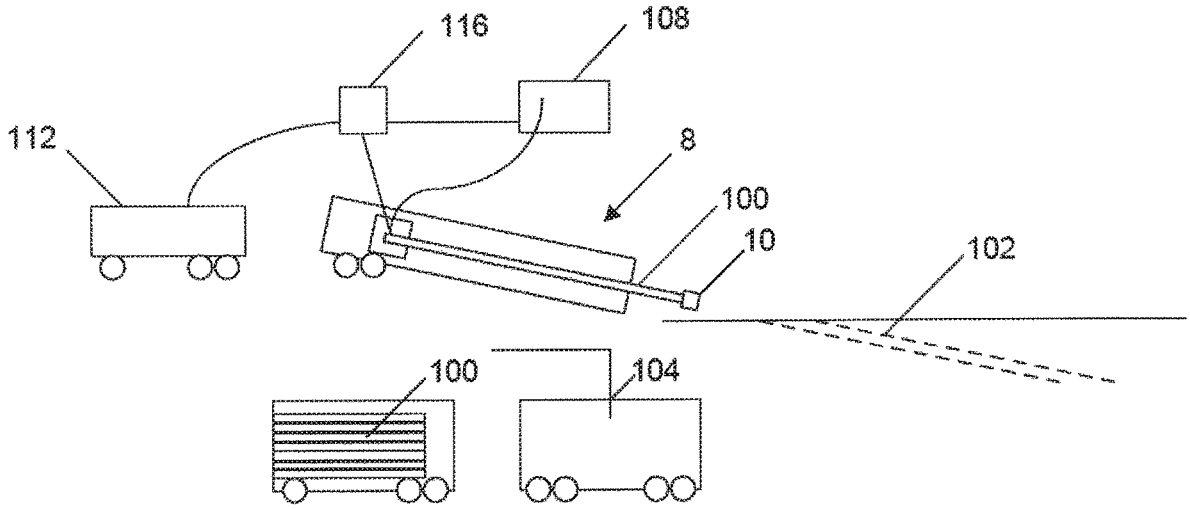
FIG. 6 illustrates a drilling rig configured for use with the hole opener of FIG. 1.

10 to a horizontal directional drilling rig 8 (FIG. 6) for gouging, tearing, scraping, or chipping away ground material during a drilling operation. The reamer 10 is particularly suited for use with the horizontal directional drilling rig 8 for creating underground bores. The underground bores are used for utilities, including water lines, sewer lines, gas lines, electrical conduits, communication lines or conduits, direct buried electrical wires, and the like. Although the reamer 10 is particularly suited for use with the horizontal directional drilling rig 8, but in other embodiments, the reamer 10 can be configured for use with other types of drilling rigs.

With reference to FIG. 1, the shaft 12 includes a first end 18 and a second end 20 and a longitudinal axis 22 that extends centrally through the ends 18, 20. An aperture 24 is formed in the first end 18 and the second end 20 of the shaft 12. The apertures 24 are configured (e.g., threaded connection, pin connection, etc.) to mate with extension rods or drive rods 100 (FIG. 6) to connect the reamer 10 to the horizontal directional drilling rig 8. Rotation of the extension rods 100 by the drilling rig 8 rotates the shaft 12 about the axis 22 to perform the underground boring or drilling operation. Further, the reamer 10 is pushed or pulled underground in the direction of arrow 32 in FIG. 1 while the reamer 10 rotates about the axis 22. The reamer 10 increases the diameter of the underground bore as the reamer 10 travels in the direction of arrow 32.

Figure 2:
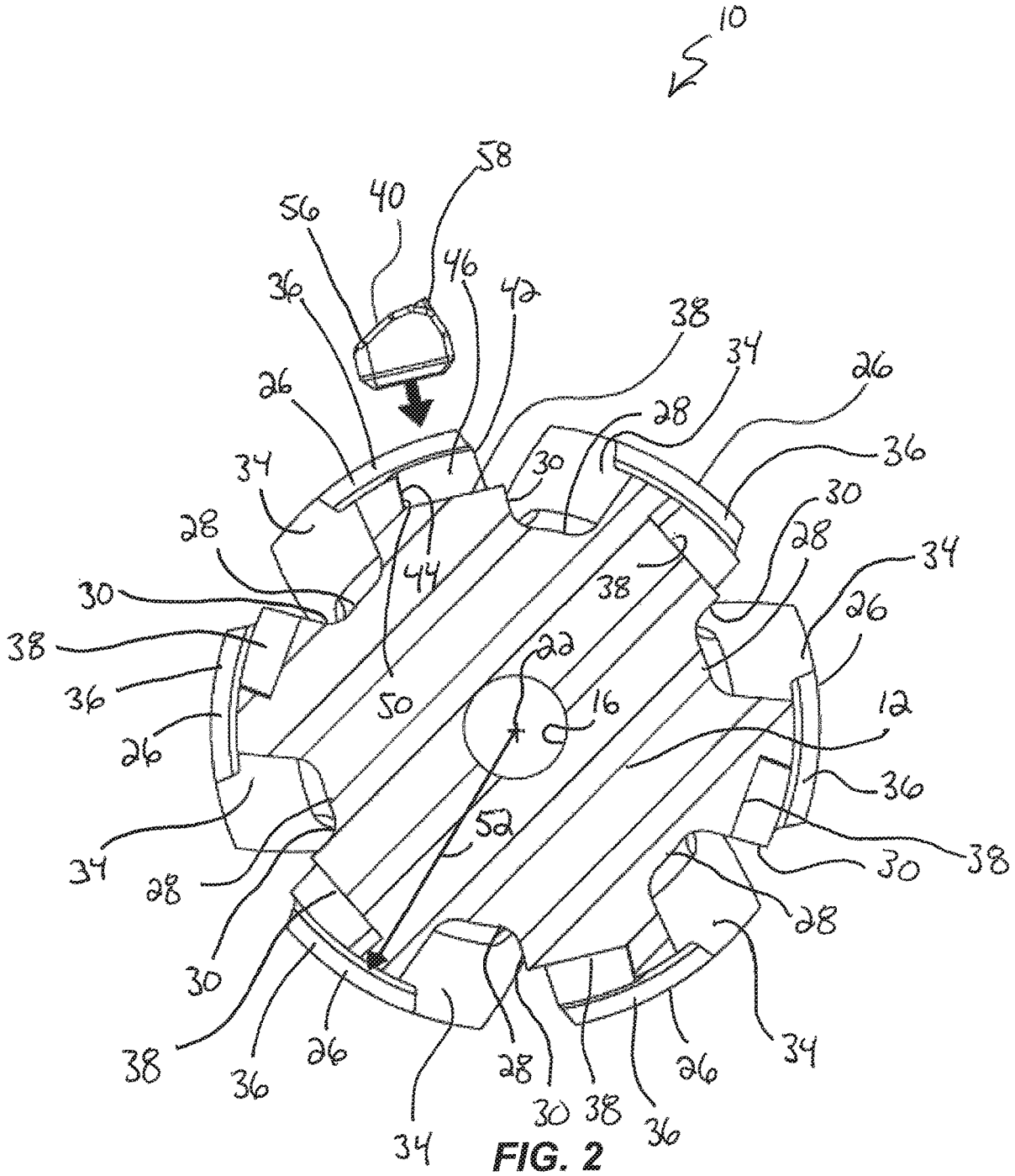
FIG. 2 is a cross-sectional view of the hole opener taken along line 2-2 of FIG. 1, illustrating a cutter block exploded from the hole opener.

With reference to FIGS. 1 and 2, the reamer 10 includes flutes 26 and cutter blocks 40 that are removably coupled to the flutes 26. The flutes 26 extend radially outwardly from the shaft 12 and generally along and around the longitudinal axis 22 in a helical path. Adjacent flutes 26 are spaced apart in a direction around the longitudinal axis 22 such that a groove 28 is between adjacent flutes 26. The grooves 28 facilitate the discharge of ground material in a direction opposite of the arrow 32, which is the travel direction of the reamer 10 during a cutting operation. Drilling fluid apertures 54 are located in the grooves 28. The apertures 54 extend to a bore 16 (FIG. 2) of the shaft 12. The bore 16 extends between the ends 18, 20 of the shaft 12. The bore 16 and the apertures 54 allow drilling fluid (e.g., bentonite clay) to be pumped through the extension rods 100 and through the shaft bore 16 and the apertures 54. The drilling fluid stabilizes the bore drilled by the reamer 10 and also removes material cut by the reamer 10 from the grooves 28.

Each flute 26 includes a first side 30 that faces toward an adjacent flute 26 and a second side 34 that faces toward an adjacent flute 26 opposite the first side 30. A top side 36 of the flute 26 extends from the first side 30 to the second side 34. The top sides 36 of the flutes 26 include recesses 38 that are spaced apart along the top side 36 of the flute 26 in a direction from the first end 18 of the shaft 12 to the second end 20 of the shaft 12. The recesses 38 each receive one of the cutter blocks 40 (although only one cutter block 40 is shown exploded in FIG. 1) to removably couple the cutter blocks 40 of the flute 26. The recesses 38 include an open end 42. The open end 42 may be located at either the first side 30 or the second side 34 of the flute 26. The recesses 38 further include a closed end 44 formed by an end wall 50 opposite the open end 42. A first side wall 46 extends from the open end 42 to the closed end 44 and a second side wall 48 extends from the open end 42 to the closed end 44. The first side wall 46 is parallel to the second side wall 48 in the illustrated embodiment and the end wall 50 is perpendicular to the walls 46, 48 in the illustrated embodiment. The flutes 26 further include a flute radius 52 (FIG. 2) that is measured from the longitudinal axis 22 of the shaft 12 to the top side 36 of the flute 26 as shown in FIG. 2. The flute radius 52 increases in a direction from the first end 18 of the shaft 12 toward the second end of the shaft 20.

Figure 3A:
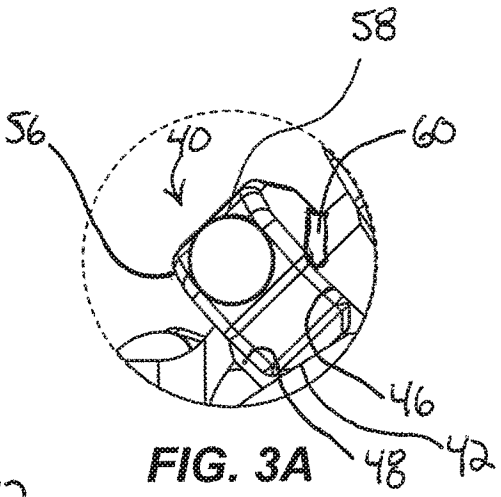
FIG. 3A is an enlarged view of the cutter block.
Figure 3:
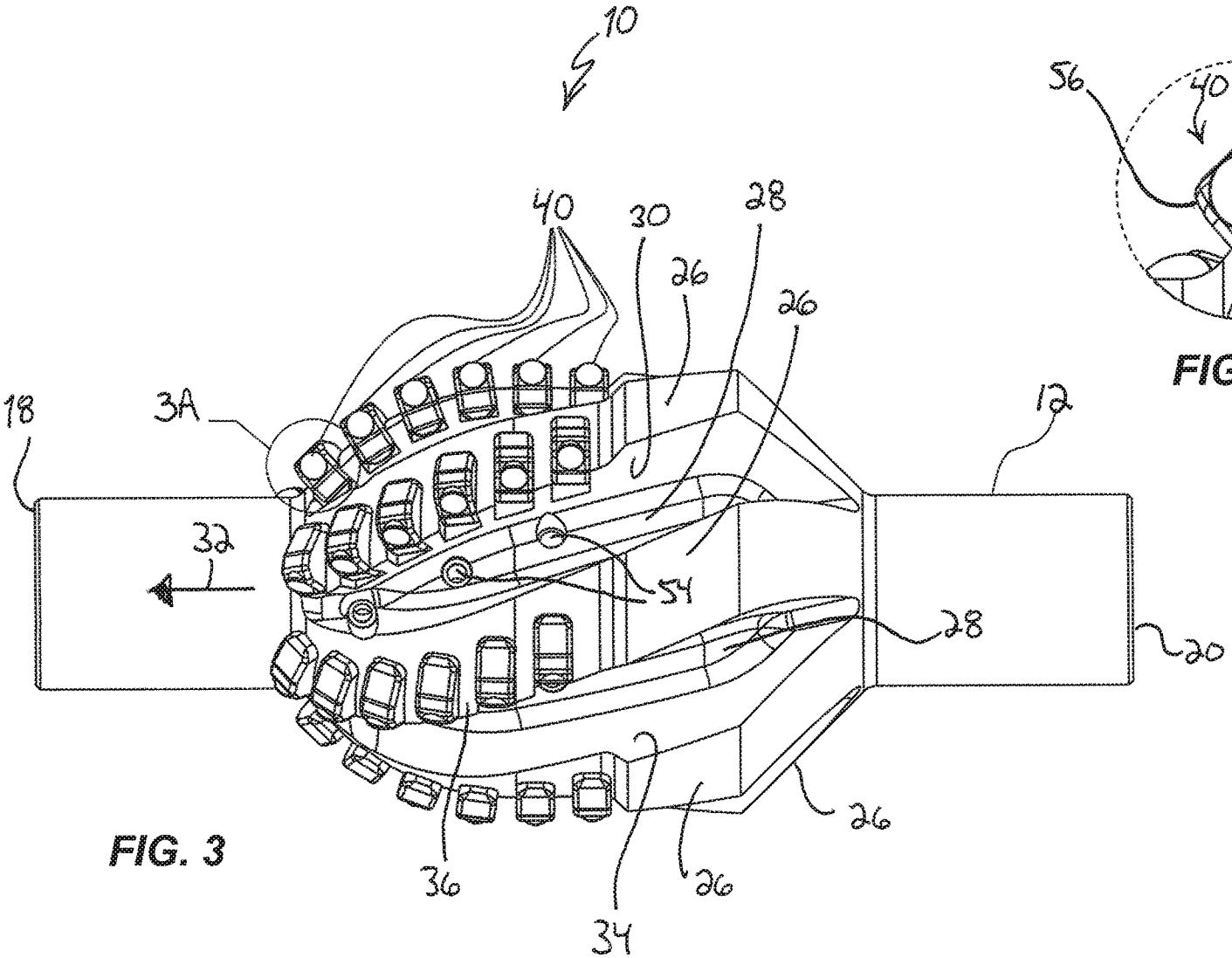
FIG. 3 is a side view of the hole opener of FIG. 1, illustrating the cutter blocks coupled to the hole opener.

With reference to FIGS. 3 and 3A, the cutter blocks 40 each include a base 56 and a cutter 58 attached to the base 56. The base 56 is formed from a first material and the cutter 58 is formed from a second material different than the first material. The first material is suitable for welding the cutter blocks 40 to the flutes 26 and the second material is more suitable for cutting, scraping, or gouging ground material. In one embodiment the first material of the base 56 is metal and is the same material as the flutes 26. In one embodiment, the second material of the cutters 58 include polycrystalline diamond compact (PDC) cutters, tungsten carbide cutters, cubic boron nitride cutters, or other similar type of cutters.

The base 56 is received in one of the recesses 38 and the base 56 is welded to the flute 26. In one embodiment, a fillet weld 60 (FIG. 3A) is used to attach the cutter blocks 40 to the flute 36. The base 56 is received in the recesses 38 by sliding the base 56 into the open end 42 of the recess 38 until the base 56 abuts the end wall 50 (FIG. 1) of the recess 38. The base 56 also contacts the side walls 46, 48 of the recesses 38 to position the cutter block 40.

When the cutter 58 becomes worn or dull, the cutter block 40 is removed and replaced by removing weld 60 (FIG. 3A) and welding a new cutter block 40 into the recess 38. Therefore, the only the worn cutter blocks 40 are disposed rather than the entire reamer 10 or cutters 58 that are still usable. The recesses 38 also help the user easily locate the proper position the new cutter block 40 relative to the flute 26. The user simply inserts the new block 40 into the recess 38 to properly locate the new block 40. The recesses 38 provides a locating function for the user when replacing the cutter blocks 40. Also, the recesses 38 properly position the new cutter block 40 at the desired angle relative to the axis 22.

Figure 4:
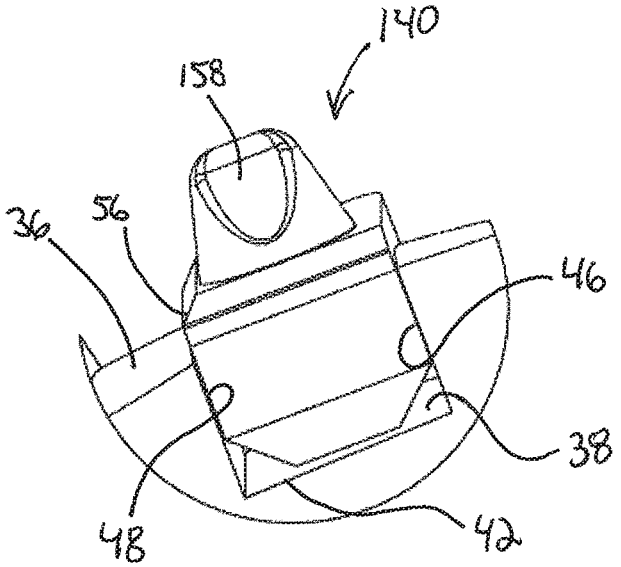
FIG. 4 is an enlarged view of an alternative cutter block attached to the hole opener of FIG. 1.
Figure 5:
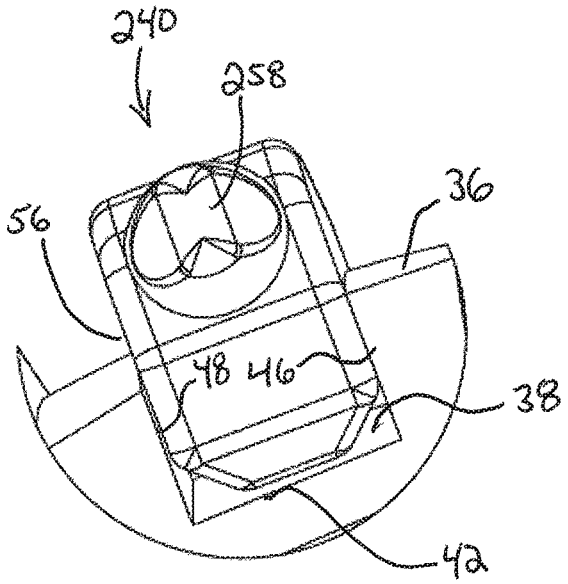
FIG. 5 is an enlarged view of an alternative cutter block attached to the hole opener of FIG. 1.

Also, the cutter blocks 40 can be replaced with different types of cutter blocks depending on the drilling operation and/or ground material encountered during a drilling operation. For example, with reference to FIGS. 4 and 5, a second cutter block 140 or a third cutter block 240 may be inserted and welded into the recesses 38 of the flutes 26. The second cutter block 140 has a second cutter 158 and the third cutter block 240 has a third cutter 258. The second cutter 158 and the third cutter 258 are different than the first cutter 58 yet the bases 56 are generally the same. As a result, the reamer 10 is suitable for a variety of different ground materials during the drilling operation depending on the configuration of cutter blocks 40, 140, 240 implemented. For example, the cutter block 40 with the cutter 58 is also suitable for scraping away the ground material, whereas the second cutter block 140 with the second cutter 158 is more suitable for picking away the ground material, and the third cutter block 240 with the third cutter 258 is more suitable for gouging away the ground material. The cutter blocks 40, 140, 240 are interchangeable, thus enabling a single hole opener, such as the reamer 10, to serve the purpose of multiple hole openers. Also, the reamer 10 can include different combinations of the cutter blocks 40, 140, 240 on the same reamer 10. For example, less expensive cutter blocks can be located on positions of the reamer that see more wear while more expensive cutter blocks can be located on positions of the reamer that see less wear.

The reamer 10 is particularly suited for use with a horizontal directional rig 8. The drilling rig 8 includes extension rods 100, a crane 104 for moving extension rods 100 onto and off of the drill rig 8, a control trailer 108 where an operator controls the drilling operation of the drill rig 8, a mud rig 112 for holding cuttings from the drill rig 8, and a power unit 116 providing power to the drill rig 8, the mud rig 112, and the control trailer 108.

In the cutting operation, extension rods 100 are moved by the crane 104 onto the drill rig 8. The extension rods 100 are translated through a hole 102 to be reamed to the opposite end (not shown) of the hole 102, with additional extension rods 100 being added to the extension rods 100 within the hole 102 as the extension rods 100 are translated through the hole 102. The extension rods 100 are attached to the reamer 10. An operator in the control trailer 108 supplies power through the power unit 116 to the drill rig 8 to rotate the hole opener 10 and translate the hole opener 10 along a cutting path of the hole 102. In some embodiments, the cutting path of the hole 102 is directed towards the drill rig 8, and the hole opener 10 is pulled through the hole 102. In this embodiment, the crane 104 lifts extension rods 100 from the drill rig 8 as they are translated out of the hole 102. Alternatively, the cutting path of the hole 102 can be directed away from the drill rig 8, and the hole opener 10 is pushed through the hole 102 by the drill rig 8. In this alternative embodiment, the crane 104 lifts extension rods 100 to apply them to the drill rig 8 as they are needed to further translate the hole opener 10 through the hole 102. During drilling, cuttings from within the hole 102 created by the hole opener 10 are excavated into the mud rig 112 for removal from the reamed hole 102.

Various features of the invention are set forth in the following claims.

What is claimed is:

1. A hole opener configured for use with a directional drilling rig, the hole opener comprising:

a shaft configured for rotation by the directional drilling rig about a longitudinal axis, the shaft including a first end and a second end opposite the first end;

a plurality of flutes that extend outwardly from the shaft, each of the plurality of flutes spaced from adjacent flutes in a direction around the longitudinal axis, each of the flutes including a first side that faces toward an adjacent flute, a second side that faces toward an adjacent flute opposite the first side, and a top side that extends from the first side to the second side, each of the plurality of flutes includes a plurality of recesses in the top side that are spaced apart along the top side of the flute in a direction from the first end of the shaft toward the second end of the shaft, each of the plurality of recesses being generally planar and recessed from the top side of the flute;

a plurality of cutter blocks, each of the plurality of cutter blocks including a base and a cutter attached to the base, the base received in one of the plurality of recesses to removably couple the cutter block to the flute; and a weld that fixes the cutter block to the flute with the cutter block received in the recess, the weld being removable to replace the cutter block with a second cutter block in the one of the plurality of recesses.

2. The hole opener of claim 1, wherein the plurality of recesses each include an open end at one of the first side of the flute and the second side of the flute and a closed end opposite the open end.

3. The hole opener of claim 2, wherein the plurality of recesses each include a first side wall that extends from the open end to the closed end and a second side wall that extends from the open end to the closed end opposite the first side wall.

4. The hole opener of claim 3, wherein the first side wall is parallel to the second side wall.

5. The hole opener of claim 4, wherein the plurality of recesses each include an end wall opposite the open end, wherein the base of the cutter block abuts the end wall.

6. The hole opener of claim 5, wherein the end wall is perpendicular to the first and second side walls.

7. The hole opener of claim 1, wherein the base of each of the plurality of cutter blocks is formed from a first material and wherein the cutter is formed from a second material different than the first material.

8. The hole opener of claim 7, wherein the first material includes metal.

9. The hole opener of claim 8, wherein the second material includes polycrystalline diamond compact.

10. The hole opener of claim 7, wherein the plurality of flutes are formed from the first material.

11. The hole opener of claim 1, wherein the cutter includes a cutter selected from the group consisting of: polycrystalline diamond compact cutters, tungsten carbide cutters, and cubic boron nitride cutters.

12. The hole opener of claim 1, further comprising a plurality of welds that couple the bases of the plurality of cutter blocks to the plurality of flutes.

13. The hole opener of claim 12, wherein the plurality of welds include fillet welds.

14. The hole opener of claim 1, wherein any one of the plurality of cutter blocks is receivable in any one of the plurality of recesses.

15. The hole opener of claim 1, wherein each of the plurality of flutes is arranged in a helical path about the longitudinal axis.

16. The hole opener of claim 1, wherein each of the plurality of flutes includes a flute radius that is measured from the longitudinal axis of the shaft to the top side of the flute, wherein the flute radius of each of the plurality of flutes increases in a direction from the first end of the shaft toward the second end of the shaft.

17. The hole opener of claim 1, further comprising a groove between adjacent flutes.

18. The hole opener of claim 17, further comprising a drilling fluid aperture in each of the plurality of grooves.

19. The hole opener of claim 1, wherein the first end of the shaft includes an aperture configured to couple the hole opener to the directional drilling rig.

20. The hole opener of claim 1, wherein the shaft includes a bore that extends from the first end of the shaft toward the second end of the shaft, the shaft further comprising a plurality of drilling fluid apertures between the plurality of flutes in fluid communication with the bore of the shaft.

* * * * *